US009056694B2

(12) United States Patent
Aksan et al.

(10) Patent No.: US 9,056,694 B2
(45) Date of Patent: Jun. 16, 2015

(54) STACKING TRAY

(75) Inventors: Yavuz Aksan, Suwanee, GA (US); Wayne P. Gasior, Duluth, GA (US); Ernest Widner, Gainesville, GA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 327 days.

(21) Appl. No.: 13/449,338

(22) Filed: Apr. 18, 2012

(65) Prior Publication Data

US 2013/0092588 A1 Apr. 18, 2013

Related U.S. Application Data

(60) Provisional application No. 61/546,643, filed on Oct. 13, 2011.

(51) Int. Cl.

| | |
|---|---|
| ***B65D 5/22*** | (2006.01) |
| ***B65D 5/00*** | (2006.01) |
| ***B65D 5/42*** | (2006.01) |
| ***B65D 5/468*** | (2006.01) |
| ***B65D 5/52*** | (2006.01) |

(52) U.S. Cl.

CPC ..... *B65D 5/0015* (2013.01); *B65D 5/22* (2013.01); *B65D 5/4295* (2013.01); *B65D 5/4608* (2013.01); *B65D 5/5273* (2013.01)

(58) Field of Classification Search

CPC ..... B65D 5/5021; B65D 5/22
USPC ..... 229/172, 173, 182.1, 120.18, 119, 229/122.32, 122.34; 206/557
See application file for complete search history.

(56) References Cited

U.S. PATENT DOCUMENTS

| | | | | |
|---|---|---|---|---|
| 2,465,169 | A * | 3/1949 | O'Connor | 206/562 |
| 2,944,720 | A * | 7/1960 | Levkoff | 206/521 |
| 3,009,622 | A * | 11/1961 | Leone | 206/485 |
| 3,314,530 | A * | 4/1967 | Michalka | 206/756 |
| 4,832,199 | A | 5/1989 | Rigby | |
| 5,125,568 | A | 6/1992 | Bauer | |
| 5,295,623 | A | 3/1994 | Bacques et al. | |
| 5,395,043 | A | 3/1995 | Bacques et al. | |
| 5,505,309 | A * | 4/1996 | Taravella et al. | 206/485 |
| 5,529,187 | A * | 6/1996 | DeNola | 206/449 |
| 5,535,942 | A * | 7/1996 | Vilona | 229/199 |
| 5,669,500 | A | 9/1997 | Sutherland | |
| 6,116,498 | A * | 9/2000 | Sheffer | 229/114 |
| 6,394,742 | B1 | 5/2002 | Buscema | |

(Continued)

FOREIGN PATENT DOCUMENTS

| | | | |
|---|---|---|---|
| EP | 2535284 | B1 | 7/2014 |
| FR | 2987037 | A1 * | 8/2013 |

(Continued)

OTHER PUBLICATIONS

International Search Report and International Written Opinion of the Searching Authority for PCT/US2012/059943 mailed Mar. 18, 2013.

*Primary Examiner* — Justin Larson
*Assistant Examiner* — Phillip Schmidt
(74) *Attorney, Agent, or Firm* — William W. Letson; Crystal Jones

(57) ABSTRACT

The present application provides a stacking tray for use with a number of products. The stacking tray may include a floor, a wall extending from the floor, and a subpanel. The subpanel may extend from the wall at an angle towards the floor.

30 Claims, 6 Drawing Sheets

(56) References Cited

U.S. PATENT DOCUMENTS

| | | | | |
|---|---|---|---|---|
| 6,598,785 | B2 | 7/2003 | Quaintance | |
| 6,749,107 | B2 | 6/2004 | Quaintance | |
| 7,007,802 | B1 | 3/2006 | Moorman et al. | |
| 7,735,649 | B2 * | 6/2010 | Kim-Gifford et al. | 206/485 |
| 7,743,970 | B2 | 6/2010 | Bates et al. | |
| 7,832,621 | B2 | 11/2010 | Smalley | |
| 8,690,047 | B2 | 4/2014 | McKenna et al. | |
| 2001/0042783 | A1 | 11/2001 | Jackson | |
| 2005/0184139 | A1 | 8/2005 | Gasior | |
| 2007/0051789 | A1 * | 3/2007 | Panduro et al. | 229/175 |
| 2007/0251854 | A1 * | 11/2007 | McDonald et al. | 206/583 |
| 2009/0095799 | A1 | 4/2009 | Garner | |
| 2009/0121003 | A1 | 5/2009 | Garner | |
| 2009/0121006 | A1 | 5/2009 | Gasior | |
| 2009/0266874 | A1 | 10/2009 | Smith | |
| 2010/0032334 | A1 | 2/2010 | Weideman | |

FOREIGN PATENT DOCUMENTS

| | | | |
|---|---|---|---|
| JP | 2002-114217 | A1 | 4/2002 |
| JP | 2002-347754 | A1 | 12/2002 |
| JP | 2009-280266 | A1 | 12/2009 |

* cited by examiner

STACKING TRAY

TECHNICAL FIELD

The present application and the resultant patent relate generally to a stacking tray and more particularly relate to a reinforced stacking tray with an angled sub-panel so as to promote presentation and drainage while resisting sag.

BACKGROUND OF THE INVENTION

Corrugated trays and cartons are in wide use to pack, ship, and display produce such as pineapples, melons, bananas, and the like. These trays and cartons generally are stackable so as to provide easy shipping and distribution. Many different designs and configurations are known. One drawback with many known designs is that the bottom floor of these trays or cartons tends to sag when exposed to moisture. For example, moisture dripping from the produce or elsewhere onto the bottom floor of a tray may cause the bottom floor to sag downward under the weight of the produce. Given such sagging, the produce in the lower trays of a stack of trays may be compressed and damaged.

There is thus a desire for an improved stackable tray. Desirably, such a stackable tray may accommodate moisture levels typically associated with produce and the like with minimized sagging so as to protect the produce or other objects therein from damage. Moreover, such a stackable tray should be easy to erect, easy to use, and economical to produce.

SUMMARY OF THE INVENTION

The present application and the resultant patent thus provide a stacking tray for use with a number of products. The stacking tray may include a floor, a wall extending from the floor, and a subpanel. The subpanel may extend from the wall at an angle towards the floor.

The present application and the resultant patent further provide a blank for erecting a stacking tray. The tray may include a floor panel forming a floor, a first side panel foldably attached to the floor panel, a second side panel foldably attached to the first side panel with the first side panel and the second side panel forming a side wall, and a third side panel foldably attached to the second side panel with the third side panel forming a subpanel extending from the side wall at an angle towards the floor.

The present application and the resultant patent further provide a method of measuring sag in tray and the like. The method may include the steps of placing a number of trays in a stack, placing one or more products in a tested tray of the stack, measuring a first length between a floor of a lower tray and a floor of the tested tray, placing a load on the stack, measuring a second length between the floor of the lower tray and the floor of the tested tray, and determining the difference between the first length and the second length.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
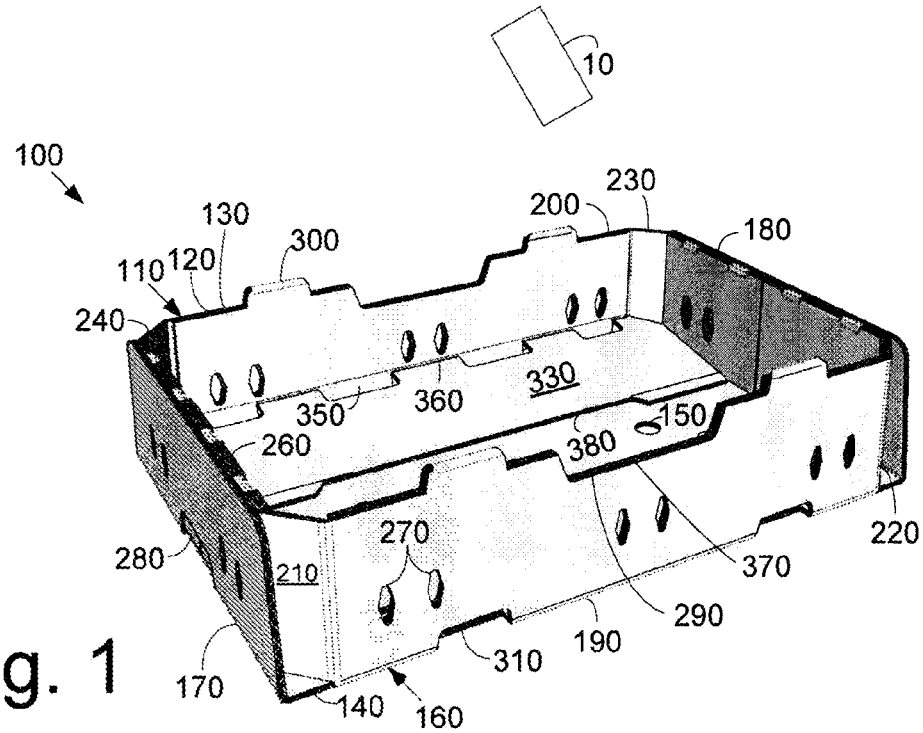
FIG. 1 is a perspective view of an example of stackable tray as may be described herein.
Figure 2:
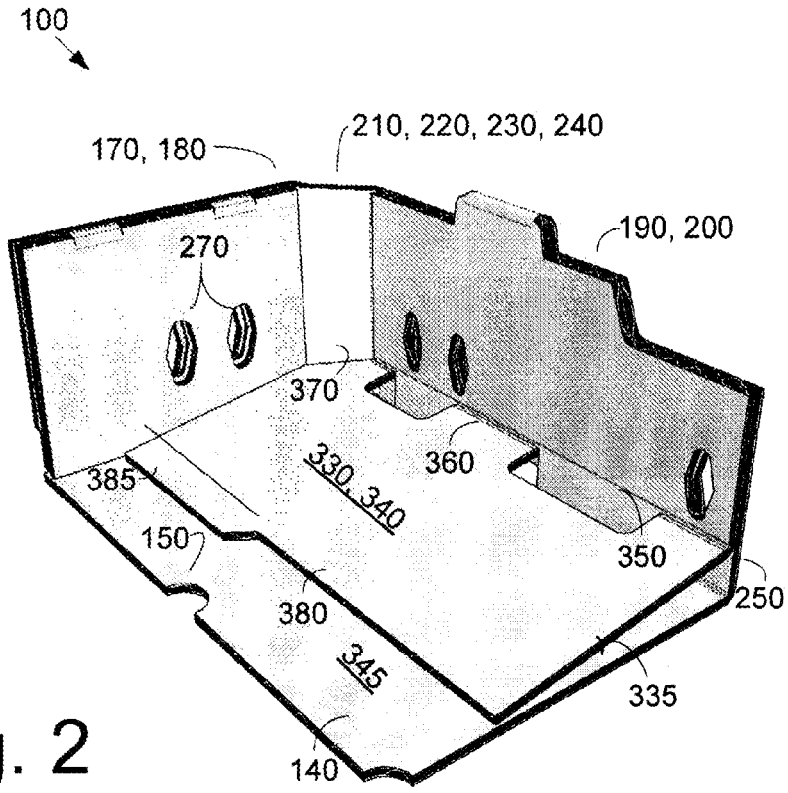
FIG. 2 is a partial side cross-sectional view of the tray of FIG. 1.

Referring now to the drawings, in which like numerals refer to like elements throughout the several views, FIG. 1 and FIG. 2 show an example of a tray 100 as may be described herein. In this example, the tray 100 may be a stackable tray 110. Any number of stackable trays 110 may be stacked on top of each other as desired. The tray 100 may contain any number or types of products 10 therein. The products 10 may include produce such as pineapples, melons, bananas, and the like. The products 10 may tend to include an amount of moisture thereon or therein. In describing the tray 100, the terms "bottom," "top," "side," "end," and the like are used for purposes of relative orientation only and not as an absolute position. For example, any surface of the tray 100 may be used as the bottom or the top as oriented by the user. The tray 100 may be made out of corrugated board stock 120 and the like. The corrugated board stock 120 may have a single wall construction 130 and may be coated or uncoated. Other types of corrugated board stock such as double wall constructions and the like may be used herein. Any type of graphics also may be used. Other types of substrates also may be used herein. The overall size of the tray 100 may be standardized according to the intended industry of use. For example, a five down configuration and the like may be used herein.

The tray 100 may include a bottom floor 140. The bottom floor 140 may be relatively flat or linear. The bottom floor 140 may include a number of drain holes 150 therein. The tray 100 also may include a number of walls 160. In this example, eight (8) walls 160 may be used. Specifically, a first end wall 170, a second end wall 180, a first sidewall 190, and a second sidewall 200 are shown. (Generally described, the sidewalls 190, 200 have a longer length than the end walls 170, 180, but not necessarily. The terms may be used interchangeably herein.) Each end wall 170, 180 may be connected to a sidewall 190, 200 via a diagonal wall: a first diagonal wall 210, a second diagonal wall 220, a third diagonal wall 230, and a fourth diagonal wall 240. Any number of walls 160 may be used herein. The end walls 170, 180 and the sidewalls 190, 200 may have a slight inward canter 250. The inward canter 250 may be about three degrees (3°) or so off of a vertical plane. Other angles may be used herein. Although the walls 160 are shown as being straight or linear, curved walls 160 and the like also may be used herein. Other components and other configurations may be used herein.

Each of the end walls 170, 180 may be a triple paneled member 260. In other words, each of the end walls 170, 180 may include three (3) distinct panels that may be joined together to form the walls 170, 180. As will be described in more detail below, each of the panels of the triple paneled member 260 may extend across the length of the end walls 170, 180 in whole or in part. Although three (3) panels are shown, any number of panels more than two (2) may be used herein. The end panels 170, 180 may include a number of vent holes 270 formed therethrough. Likewise, the end walls 170, 180 may include a number of hand grips 280 formed therein. The hand grips 280 may extend through the triple paneled member 260 of the end walls 170, 180 in whole or in part. Other components and other configurations also may be used herein.

Each of the side walls 190, 200 may be a double paneled member 290 with two (2) distinct panels the may be joined together. Each of the panels of the double paneled members 290 may extend across the length of the side walls 190, 200 in whole or in part. The side walls 190, 200 may include a number of stacking tabs 300 on a top end thereof and a number of aligned stacking tab receptacles 310 at a bottom end thereof. Any number of the stacking tabs 300 and the stacking tab receptacles 310 may be used in any configuration. The side walls 190, 200 also may include a number of the ventilation holes 270 positioned therethrough in any configuration. The sidewalls 190, 200 also may have a viewing aperture 320 formed therein in any configuration. The stacking tabs 300, the stacking tab receptacles 310, and the viewing aperture 320 also may be positioned on the end walls 170, 180 while the hand grip 280 may be positioned on the sidewalls 190, 200. Other components and other configurations may be used herein.

The diagonal walls 210-240 may extend over a portion of the bottom floor 140. The diagonal walls 210-240 may continue into the end walls 170, 180 as part of the triple paneled member 260 and may be foldably attached thereto. The portion of the bottom floor 140 that extends beyond the diagonal walls 210-240 may or may not be cut off in whole or in part. Other components and other configurations also may be used herein.

The tray 100 also may include a pair of sub-panels: a first subpanel 330 and a second subpanel 340. Any number of subpanels 330, 340 may be used herein. The subpanels 330, 340 may extend from an interior of the side walls 190, 200 at an angle 335 towards the bottom floor 140. The angle 335 may be about three degrees to about fifty degrees or so. Other angles may be used herein. The subpanels 330, 340 may extend above the bottom floor 140 by about 0.25 inches (about 0.635 centimeters) or more along the sidewalls 190, 200. The subpanels 330, 340 may or may not extend all of the way into the width of the bottom floor 140. If not, a void 345 may extend between the subpanels 330, 340 along the bottom floor 140 in whole or in part, i.e., some parts of the subpanels 330, 340 may touch and others may not. Likewise, the subpanels 330, 340 may or may not extend all of the way into the length of the bottom floor 140. The subpanels 330, 340 may be largely linear in shape. Alternatively, the subpanels 330, 340 may have a roof-like configuration with an apex about the middle thereof. Further, other types of slants, curve, indentations, creases, and the like may be added to aid in drainage. Other components and other configurations may be used herein.

The subpanels 330, 340 may have a number of support feet 350 positioned along the side walls 190, 200. The support feet 350 may be spaced between a number of attachment flanges 360. The support feet 350 may be cutout portions of the subpanels 330, 340 that serve to provide top to bottom support to the side walls 190, 200. Any number and configuration of the support feet 350 and the attachment flanges 360 may be used. Alternatively, the subpanels 330, 340 may be directly attached to the sidewalls 190, 200 without the support feet 350 such that all or some of the length of the subpanels 330, 340 acts as an attachment flange 360.

The subpanels 330, 340 may extend along some or all of the length of the sidewalls 190, 200 and may be in contact with the end walls 170, 180. Each of the subpanels 330, 340 may have a diagonal wall cutout 370 along the diagonal walls 210-240 and may be in contact therewith. The subpanels 330, 340 also may have a scalloped middle portion 380. The scalloped middle portion 380 and other portions of the subpanels 330, 340 serve to distribute any load thereon towards the end walls 170, 180. The subpanels 330, 340 may be aligned with the drain holes 150 on the bottom floor 140 to direct any moisture therethrough.

The unattached end of one or both subpanels 330, 340 may have one or more extensions or elevator feet 385 that may be folded downward or otherwise arranged so as to lift the unattached end off of the bottom floor 140. Any portion of the subpanels 330, 340 may be used. Alternatively, the elevator feet 385 may be separate elements that may be joined or otherwise arranged with respect to the subpanels 330, 340. The elevator feet 385 may have any desired size, shape, or configuration. Other components and other configurations may be used herein.

Figure 3:
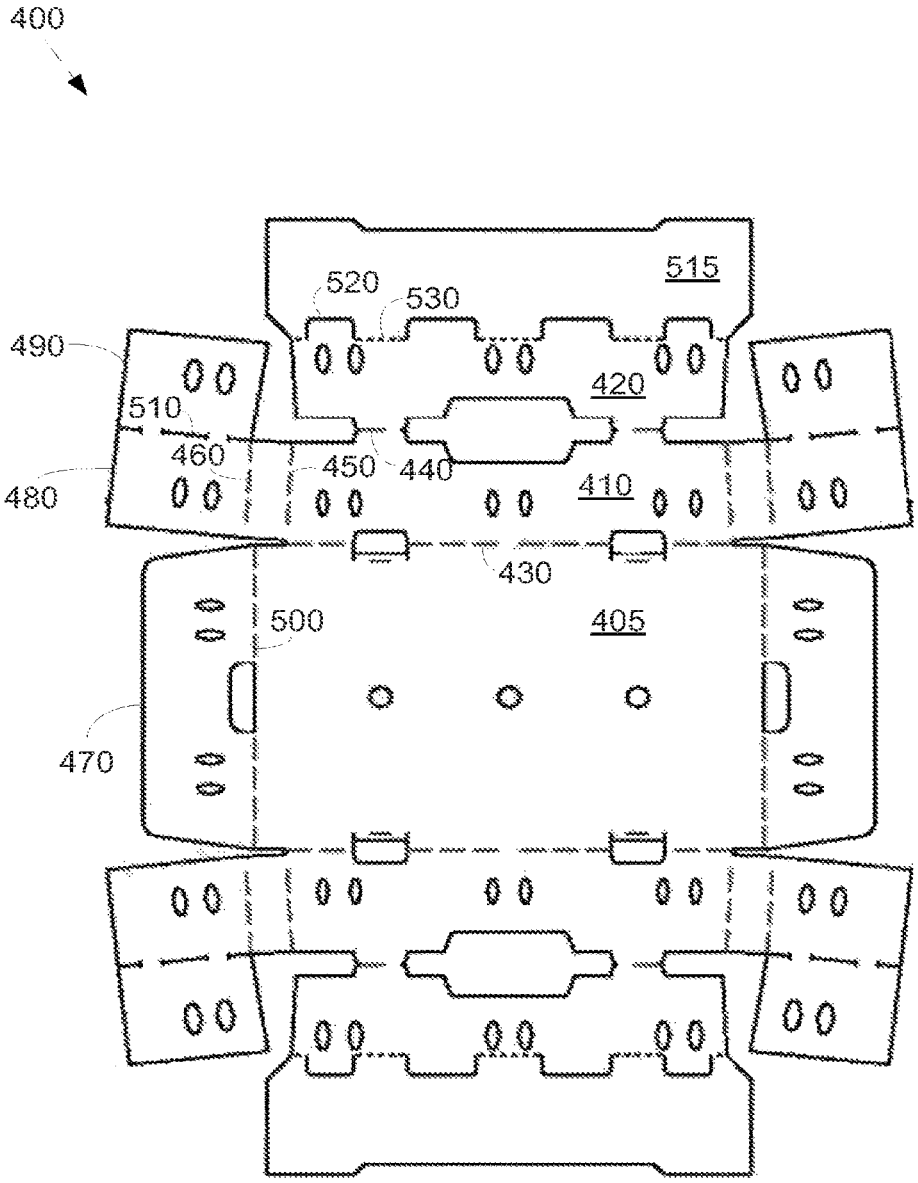
FIG. 3 is a plan view of an example of a blank that may be used to erect the tray of FIG. 1.

FIG. 3 shows an example of a blank 400 for erecting into the tray 100 such as that described above. As will be described in more detail below, the blank 400 includes a number of fold lines and/or score lines therein. It will be understood that the fold lines may be formed by crushing or scoring the corrugated board stock 120 along the line to be folded so as to facilitate bending to form the various panels and flaps. Other techniques may be used herein.

The blank 400 may be used to form the bottom floor 140; the end walls 170, 180; the side walls 190, 200; the diagonal walls 210-240; and the subpanels 330, 340. The bottom floor 140 may be formed from a bottom panel 405. The side walls 190, 200 may include the double paneled member 290. As such, the side walls 190, 200 each may include a first side wall panel 410 and a second side wall panel 420. The first side wall panel 410 may be attached to the bottom panel 405 of the bottom floor 140 via a fold line 430 on one end and attached to the second side wall panel 420 via a fold line 440 on the other. When present, each of the diagonal walls 210-240 may extend from the sides of the first side wall panel 410. The diagonal walls 210-240 may be formed in the first side wall panel 410 by a fold line 450 and a fold line 460 positioned along the first side wall panel 410 as will be described in more detail below.

The end walls 170, 180 may include the triple paneled member 260. As such, the end walls 170, 180 may include a first end wall panel 470, a second end wall panel 480, and a third end wall panel 490. The first end wall panel 470 may be attached to the bottom panel 405 of the bottom floor 140 via a fold line 500. The second end wall panel 480 may be attached to the first sidewall panel 410 about the diagonal walls 210-240 at the fold line 460. The third end wall panel 490 may be connected to the second end wall panel 480 via a fold line 510.

Each of the subpanels 330, 340 may be formed from a third side wall panel 515. The third side wall panel 515 may be separated from the second sidewall panel 420 via a number of cut lines 520 (to form the support feet 350) and attached via a number of fold lines 530 (to form the attachment flanges 360). A further side wall panel also may be used with respect to the elevator feet 385. The blank 400 also may include the various vent holes 270, the hand grips 280, the stacking tabs 300, the stacking tab receptacles 310, the viewing apertures 320, and the like. Other configurations also may be used herein. The blank 400 and the components thereof may have any desired size. Many variations in the overall design of the tray 100 and the blank 400 may be accommodated herein.

In order to erect the tray 100 from the blank 400, the first and second side wall panels 410, 420 may be folded along the fold line 440 while the second and the third end wall panels 480, 490 may be folded along the fold line 510. The first and the second side wall panels 410, 420 may be folded along the fold line 430 so as to form the side walls 190, 200. The third side wall panels 515 may be folded along the fold line 530 to form the subpanels 330, 340. The end walls 170, 180 and the diagonal walls 210-240 may be formed by folding the second and the third end wall panels 480, 490 along the fold line 460 and folding the first end wall panel 470 along the fold line 500. These steps may be performed in any order which provide for the assembly of the tray 100 and the like. The various flaps and panels may be attached via conventional adhesives or other types of joinder means.

In use, (1) all of the walls 160 with the slight canter 250, (2) the end walls 170, 180 with the triple paneled members 260, (3) the side walls 190, 200 with the double paneled members 290, and (4) the connecting diagonal walls 200-240, combine to provide the tray 100 with improved durability and stackability. The use of the subpanels 330, 340 provides enhanced support for the products 10 therein while minimizing sag caused by weight, moisture, and the like. Specifically, the angle 335 and orientation of the subpanels 330, 340 may be intended to direct any moisture on the products 10 towards the drain holes 150 in the bottom floor 140. As such, good drainage avoids prolonged moisture contact with the corrugated board stock 120 of the bottom floor 140 so as to resist sagging. Likewise, the subpanels 330, 340 aid in distributing the load of the products 10 to the side walls 190, 200 via the attachment flanges 360 while also promoting load distribution towards the end walls 170, 180. The inward canter 250 also aids overall compression strength while improving ventilation. Likewise, the ventilation holes 270 provide good ventilation into the tray 100 when positioned in a stack in any orientation such as a five down configuration and the like.

Figure 4:
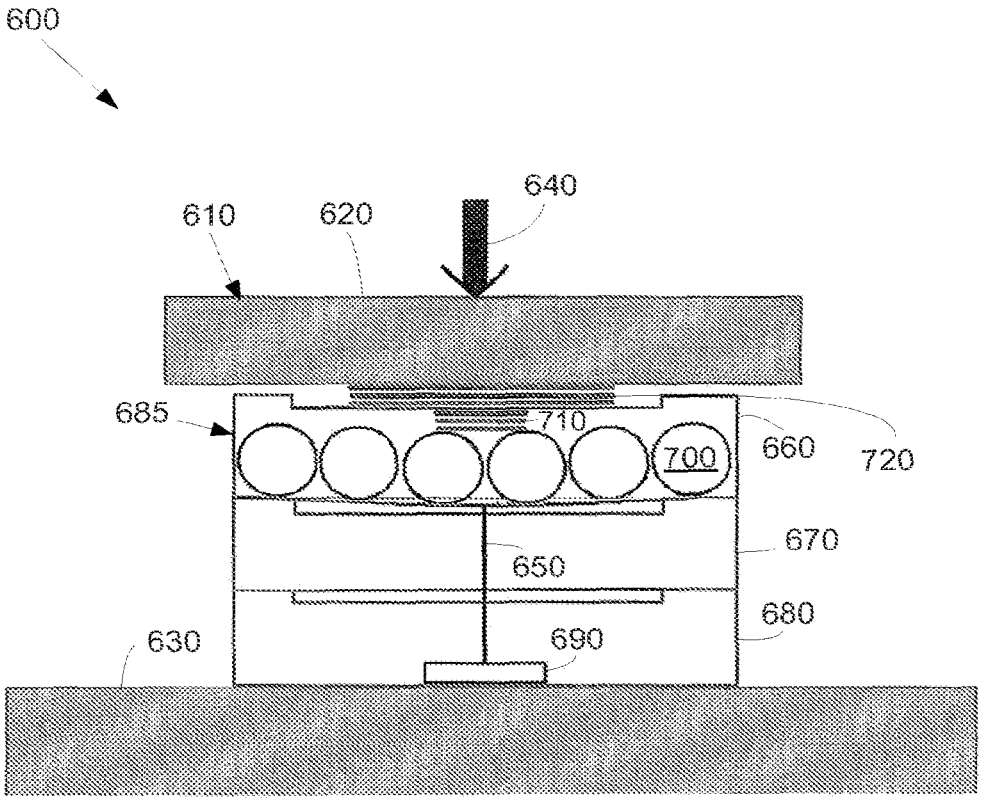
FIG. 4 is a schematic diagram of an example of a sag tester as may be described herein.

In order to measure the improved resistance to sag in the trays described herein, an objective sag test was developed. FIG. 4 shows one example of a sag tester 600 as may be described herein. The sag tester 600 may include a conventional box compression tester 610. The box compression tester 610 generally includes a pair of parallel platens, a first platen 620 and a second platen 630. The box compression tester 610 may exert a dynamic load 640 on objects placed therebetween and may track force versus deflection and the like. Other methods of applying a load may be used herein. The sag tester 600 also may include a telescoping rod 650. The telescoping rod 650 may be used to determine the amount of sag via a change in length. Other components and other configurations may be used herein.

In use, a number of trays may be used to mimic the conditions found in a typical stack of trays. As such, a first tray 660, a second tray 670, and a third tray 680 may be used and assembled in a stack 685. Any number of trays may be used herein. The telescoping rod 650 may be placed on a support base 690 in a bottom or the third tray 680. The second tray 670 then may be stacked on top of the third tray 680 with the telescoping rod 650 extending through the drain hole 150 therein. A top or the first tray 660 may be stacked on the second tray 670. The drain hole 150 of the first tray 660 may be patched over. The first tray 660 thus compresses the telescoping rod 650 as the first tray 660 is placed on the second tray 670.

A number of the products 10 may be positioned in the first tray 660. Alternatively, a number of simulated products 700 may be positioned therein instead. For example, a bowling pin may accurately simulate a pineapple in both size and weight and may produce repeatable test results. In this example, the bowling pins collectively may weigh about twenty-five pounds (about 11.3 kilograms) or so. Although six (6) products 700 are shown, any number of the products 700 may be used herein. The addition of the products 700 to the first tray 660 may further compress the telescoping rod 650. The first and the second trays 660, 670 then may be removed and the length of the telescoping rod 650 may be measured.

The first and the second trays 660, 670 may be replaced on the third tray 680. A number of first corrugated pads 710 may be centered over the middle products 700 in the first tray 660. A second layer of corrugated pads 720 also may be positioned over all of the products 700 in the first tray 660. The pads 710, 720 may be used to mimic the sagging force that would be expected by the products 700 from an upper tray in the stack 685. In other words, the middle products 700 generally experience more force than the outer products 700.

The stack 685 may be placed within the box compression tester 610. The box compression tester 610 then slowly extends at about 0.5 inches (about 1.3 centimeters) a minute until a dynamic load of about 150 pounds (about 68 kilograms) is placed on the stack 685. The 150 pound load was chosen to mimic real world loading scenarios for a specific type of product 700 such as a pineapple. Other speeds and other loads may be used herein. The load may further compress the telescoping rod 650. The load may be backed off once the 150 pound mark is reached. The stack 685 then may be removed from the box compression tester 610. The first and the second trays 660, 670 may be removed and the telescoping rod 650 again may be measured. The difference between the first measurement and the second measurement of the telescoping rod 650 generally indicates the amount of sag in the first tray 660.

Repeated testing on conventional trays with similar amounts of material therein showed an average sag of about 26 millimeters. Testing on the trays 100 described herein and the like showed that the sag may be reduced to an average of about 17 millimeters or so. As such, the trays 100 herein showed an improved sag resistance of about thirty-five percent (35%) or more. Moreover, overall compression strength was maintained without additional material. Please note, however, that many variables made have an impact on these results. Specifically, the sag test may vary with variables such as the nature of the products therein, moisture levels, stack height, time, temperature, and the like. The sag tester 600 and the methods described herein may be applicable to other types of measurements and other types of containers and products.

Figure 5:
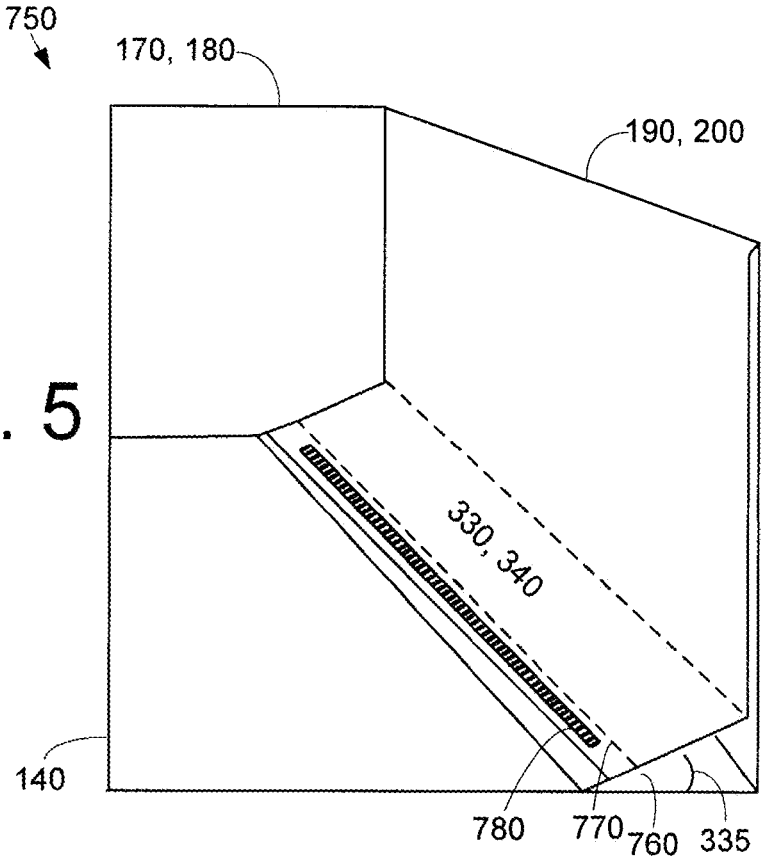
FIG. 5 is a partial side cross-sectional view of an alternative embodiment of a tray as may be described herein.

FIG. 5 shows a further embodiment of a tray 750 as may be described herein. The tray 750 may be somewhat similar to the tray 100 described above. The tray 750 may include the bottom floor 140, the end walls 170, 180, the sidewalls 190, 200, and similar structures. The tray 750 also may or may not include the diagonal walls 210, 220, 230, 240 and the like. The tray 750 may include the subpanels 330, 340 and similar structures. The subpanels 330, 340 may extend from an interior of the sidewalls 190, 200 at the angle 335 towards the bottom floor 140. Other sizes, shapes, and configurations may be used herein.

In this example, each of the subpanels 330, 340 may include a subpanel extension 760. Each subpanel extension 760 may have a largely rectangular configuration in any size although other shapes may be used herein. The subpanel extensions 760 may be connected to the subpanels 330, 340 via an extension fold line 770. The subpanel extensions 760 and the extension fold lines 770 may extend along the bottom floor 140 from about the first end wall 170 to the second end wall 180 in whole or in-part. Each subpanel extension 760 may have one or more glue lines 780 thereon. The glue lines 780 may be continuous or intermittent. The glue lines 780 may include any type of conventional adhesive. The glue lines 780 thus attach the subpanel extensions 760 to the bottom floor 140. Alternatively, the subpanel extensions 760 or one or more tabs thereof may be folded into a slot and the like in the bottom floor 140. Other types of attachment mechanisms may be used herein. Other components and other configurations may be used herein.

By gluing or otherwise attaching the subpanel extensions 760 to the bottom floor 140, movement of the subpanels 330, 340 may be substantially restrained. The restrained subpanels 330, 340 thus may provide additional structural rigidity in that the subpanels 330, 340, the bottom wall 140, and the sidewalls 190, 200 of the tray 750 largely may resemble a triangular truss structure so as to provide increased sag resistance therein.

Figure 6:
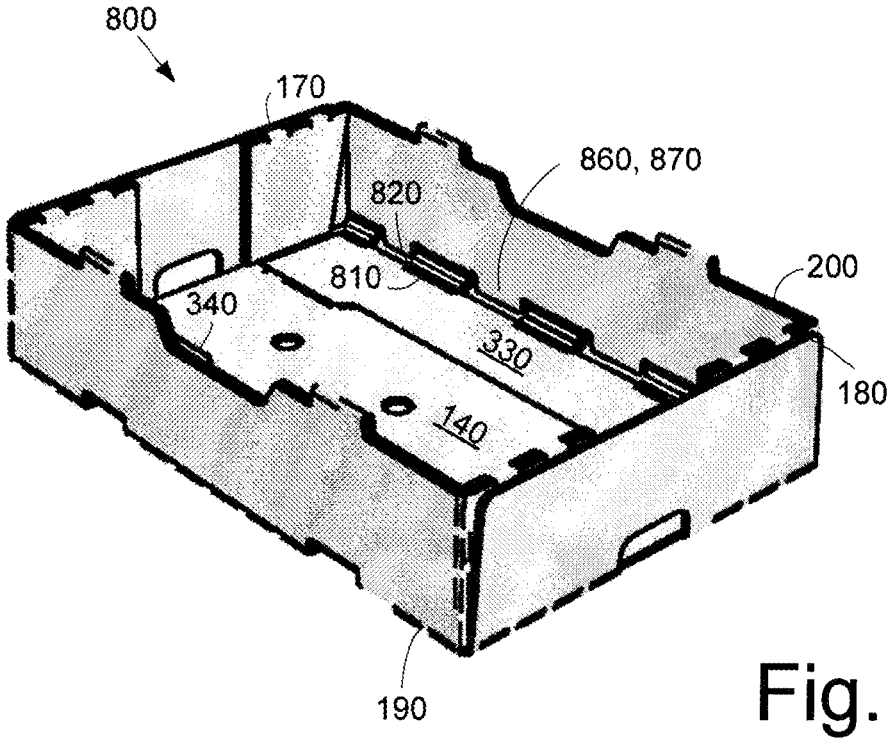
FIG. 6 is a perspective view of an alternative embodiment of a tray as may be described herein.
Figure 7:
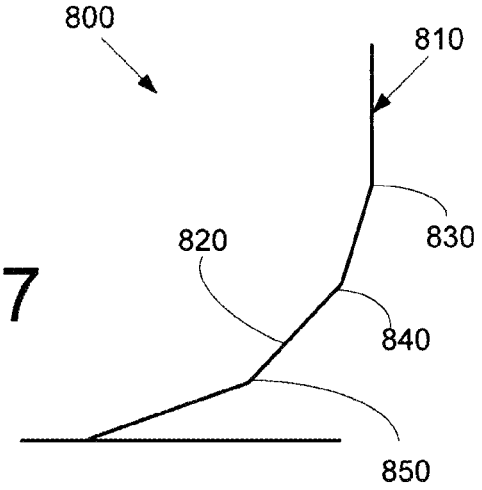
FIG. 7 is a partial side cross-sectional view of the tray of FIG. 6.

FIGS. 6 and 7 show a further embodiment of a tray 800 as may be described herein. Similar to that described above, the tray 800 may include the bottom floor 140, the end walls 170, 180, the sidewalls 190, 200, and similar structures. The diagonal walls 210, 220, 230, 240 and the like may or may not be used. The tray 800 further may include the subpanels 330, 340 and similar structures. Other sizes, shapes, and configurations may be used herein.

In this example, the tray 800 may include a number of hinged attachment flanges 810. The hinged attachment flanges 810 may connect the sidewalls 190, 200 and the subpanels 330, 340 via a tri-fold structure 820. The tri-fold structure 820 may include a first flange fold line 830, a second flange fold line 840, and a third flange fold line 850. The size, shape, and configuration of the hinged attachment flanges 810 and the flange fold lines 830, 840, 850 may vary. Any number of the hinged attachment flanges 810 and the flange fold lines 830, 840, 850 may be used herein. The hinged attachment flanges 810 may be separated by a flange cutout 860 along the length of the sidewalls 190, 200. The flange cutouts 860 may have a substantially U-shape 870. The substantial U-shape 870 may extend upwardly or downwardly. Any number of the flange cutouts 860 may be used in any size, shape, or configuration. Other components and other configurations may be used herein.

The tray 800 with the hinged attachment flanges 810 ensures that more of the load may be carried by the sidewalls 190, 200 as opposed to resting on the subpanels 330, 340. As such, less weight may be supported by the bottom floor 140 so as to provide increased sag resistance herein.

Figure 8:
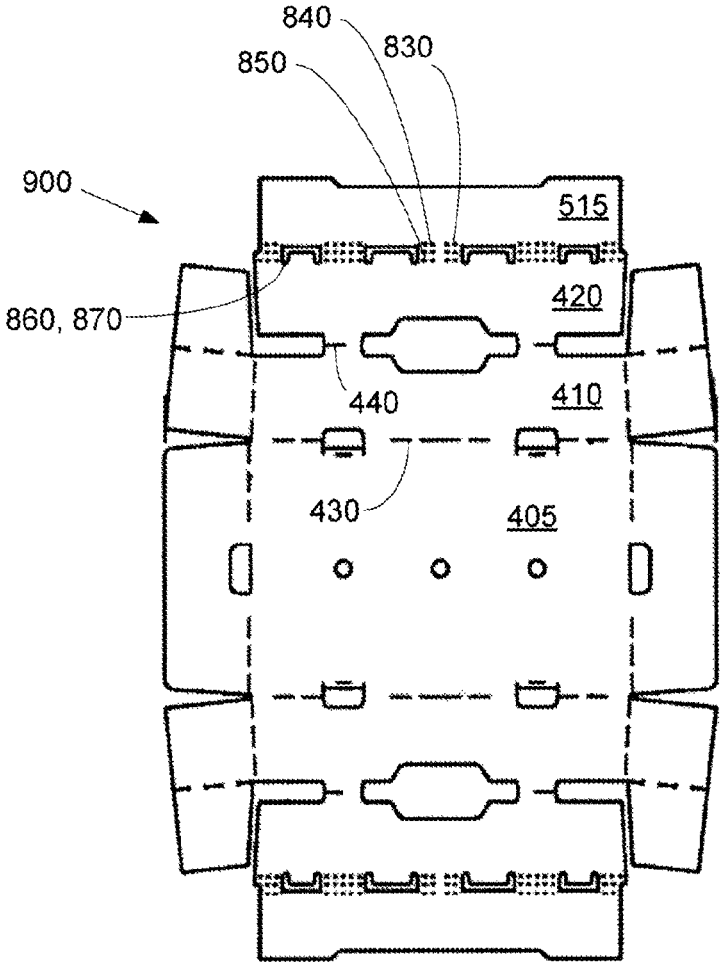
FIG. 8 is a plan view of an example of a blank that may be used erect the tray of FIG. 6.

FIG. 8 shows an example of a blank 900 that may be used to erect the tray 800 described above. The blank 900 may include the bottom panel 405 for the bottom floor 140 and the sidewall panels 410, 420 for the sidewalls 190, 200. The panels 405, 410, 420 may be separated by the fold lines 430, 440. Likewise, the side panels 330, 340 may be formed by the third sidewall panel 515.

In this example, the second and third sidewall panels 420, 515 may be separated by the three flange fold lines 830, 840, 850 of the tri-fold structure 820. The tri-fold structures 820 forming the hinged attachment flanges 810 may be separated by the flange cutout 860 with the substantial U-shape 870. The blank 900 thus may be folded accordingly with the various flaps and panels attached via conventional adhesives or other types of joinder means. Other components and other configurations may be used herein.

Figure 9:
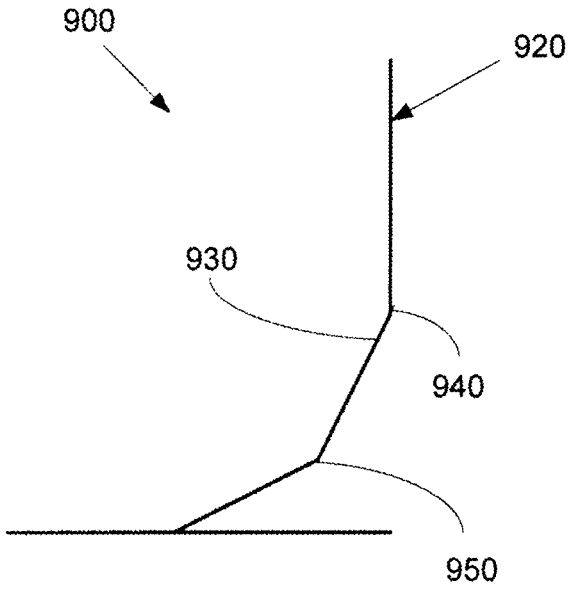
FIG. 9 is a partial side cross-sectional view of an alternative embodiment of a tray as may be described herein.

FIG. 9 shows a further example of a tray 910 as may be described herein. Similar to the tray 800 with the hinged attachment flanges 810 having the tri-fold structure 820, the tray 910 may include a number of hinged attachment flanges 920. In this example, the hinged attachment flanges 920 may include a bi-fold structure 930 with a first flange fold line 940 and a second flange fold line 950. Other types and numbers of the fold lines may be used herein in other configurations. As above, the tray 910 with the hinged attachment flanges 920 provides that more of the load may be carried by the sidewalls 190, 200 as opposed to resting on the subpanels 330, 340 for improved sag resistance.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A stacking tray for use with a number of products, comprising:

a floor;

a wall extending from the floor, the wall comprising one or more support feet positioned along a first edge of the wall; and a subpanel attached to the wall along the first edge;

the subpanel extending from the wall at an oblique angle towards the floor;

wherein the subpanel comprises a first elevator foot at a first end of a second edge of the subpanel, a second elevator foot at a second end of the second edge, and one or more first cutout portions extending along the second edge in between the first elevator foot and the second elevator foot, such that a majority of the edge is cutout and force exerted by the first elevator foot and the second elevator foot of the subpanel on the floor is diverted away from a center of the stacking tray and towards the first end and the second end of the second edge of the subpanel.

2. The stacking tray of claim 1, further comprising a plurality of walls and a plurality of subpanels.

3. The stacking tray of claim 2, wherein the plurality of walls comprises a pair of side walls.

4. The stacking tray of claim 3, wherein one of the plurality of subpanels extends from each of the pair of side walls.

5. The stacking tray of claim 3, wherein each of the pair of side walls comprises a double paneled member.

6. The stacking tray of claim 2, wherein the plurality of walls comprises a pair of end walls.

7. The stacking tray of claim 6, wherein each of the pair of end walls comprises a triple paneled member.

8. The stacking tray of claim 2, wherein the plurality of walls comprises a plurality of diagonal walls.

9. The stacking tray of claim 2, wherein one or more of the plurality of walls comprise an inward canter.

10. The stacking tray of claim 2, wherein the plurality of walls comprises one or more stacking tabs and one or more stacking tab receptacles.

11. The stacking tray of claim 2, wherein the plurality of walls comprises one or more hand grips.

12. The stacking tray of claim 2, wherein the plurality of walls comprises one or more viewing apertures.

13. The stacking tray of claim 1, wherein the wall and the subpanel comprise one or more attachment flanges.

14. The stacking tray of claim 1, wherein the subpanel comprises one or more diagonal wall cut outs.

15. The stacking tray of claim 1, wherein the subpanel comprises one or more elevator feet raise the subpanel off the floor in whole or in part.

16. The stacking tray of claim 1, further comprising a corrugated board stock.

17. The stacking tray of claim 1, wherein the floor comprises one or more drain holes.

18. The stacking tray of claim 1, wherein the wall comprises one or more ventilation holes.

19. The stacking tray of claim 1, wherein the subpanel comprises a glue strip thereon.

20. The stacking tray of claim 1, wherein the subpanel comprises a subpanel extension and wherein the subpanel extension comprises a glue strip thereon.

21. The stacking tray of claim 1, wherein the wall and the subpanel comprise one or more hinged attachment flanges.

22. The stacking tray of claim 21, wherein the one or more hinged attachment flanges comprise a plurality of fold lines.

23. The stacking tray of claim 21, wherein the one or more hinged attachment flanges comprise a tri-fold structure with a first fold line, a second fold line, and a third fold line.

24. The stacking tray of claim 21, wherein the one or more hinged attachment flanges comprise a bi-fold structure with a first fold line and a second fold line.

25. The stacking tray of claim 21, further comprising a flange cut-out positioned between a pair of the hinged attachment flanges.

26. The stacking tray of claim 25, wherein the flange cut-out comprises a substantial U-shape.

27. The stacking tray of claim 21, wherein the stacking tray is formed from an erected blank.

28. A blank for erecting a stacking tray, comprising:

a floor panel forming a floor;

a first side panel foldably attached to the floor panel;

a second side panel foldably attached to the first side panel, the second side panel comprising one or more support feet positioned along a first edge of the side panel;

the first side panel and the second side panel forming a side wall; and a third side panel foldably attached to the second side panel along the first edge;

the third side panel forming a subpanel extending from the side wall at an oblique angle towards the floor, wherein the subpanel comprises a first elevator foot at a first end of a second edge of the subpanel, a second elevator foot at a second end of the second edge, and one or more first cutout portions extending along the second edge in between the first elevator foot and the second elevator foot of the third side panel nearest the floor, such that a majority of the edge is cutout and force exerted by the first elevator foot and the second elevator foot of the subpanel on the floor is diverted away from a center of the stacking tray formed by the blank and towards the first end and the second end of the second edge of the subpanel.

29. The blank of claim 28, further comprising a plurality of end wall panels forming an end wall.

30. The stacking tray of claim 1, wherein the subpanel comprises one or more second cutout portions corresponding to and formed by the one or more support feet of the wall.

* * * * *

UNITED STATES PATENT AND TRADEMARK OFFICE

CERTIFICATE OF CORRECTION

PATENT NO. : 9,056,694 B2
APPLICATION NO. : 13/449338
DATED : June 16, 2015
INVENTOR(S) : Yavuz Aksan et al.

It is certified that error appears in the above-identified patent and that said Letters Patent is hereby corrected as shown below:

Claim 15 (Column 9, lines 1-3).

Please change Claim 15 from "The stacking tray of claim 1, wherein the subpanel comprises one or more elevator feet raise the subpanel off the floor in whole or in part" to "The stacking tray of claim 1, wherein the one or more elevator feet raise the subpanel off the floor in whole or in part."

Signed and Sealed this
Twenty-third Day of February, 2016

Michelle K. Lee

Michelle K. Lee
*Director of the United States Patent and Trademark Office*